US006940482B2

(12) United States Patent
Ishii et al.

(10) Patent No.: US 6,940,482 B2
(45) Date of Patent: Sep. 6, 2005

(54) ELECTROOPTIC DEVICE AND ELECTRONIC APPARATUS

(75) Inventors: Ryo Ishii, Matsumoto (JP); Suguru Yamazaki, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 366 days.

(21) Appl. No.: 10/180,298

(22) Filed: Jun. 27, 2002

(65) Prior Publication Data

US 2003/0011552 A1 Jan. 16, 2003

(30) Foreign Application Priority Data

Jul. 13, 2001 (JP) ..... 2001-213420

(51) Int. Cl.[7] ..... G09G 3/36
(52) U.S. Cl. ..... 345/98; 345/100; 345/94
(58) Field of Search ..... 345/89, 96, 92, 345/94, 98, 100, 55, 60, 63, 77, 82, 84, 87, 204, 205, 690

(56) References Cited

U.S. PATENT DOCUMENTS 5,945,972 A * 8/1999 Okumura et al. ..... 345/98
5,977,940 A * 11/1999 Akiyama et al. ..... 345/94
6,005,558 A * 12/1999 Hudson et al. ..... 345/204
6,160,533 A * 12/2000 Tamai et al. ..... 345/89
6,246,386 B1 * 6/2001 Perner ..... 345/90
6,348,909 B1 * 2/2002 Kim ..... 345/89
6,441,829 B1 * 8/2002 Blalock et al. ..... 345/690
6,525,709 B1 * 2/2003 O'Callaghan ..... 345/98
6,636,194 B2 * 10/2003 Ishii ..... 345/98

FOREIGN PATENT DOCUMENTS

JP A-2002-82653 3/2002

* cited by examiner

*Primary Examiner*—Kent Chang
(74) *Attorney, Agent, or Firm*—Oliff & Berridge, PLC

(57) ABSTRACT

The invention simplifies the configuration of a comparators circuit used in an electrooptic device or the like, in which gradation data is stored for each pixel, to realize lower power consumption, higher definition and multiple gradation. Transistors in which gradation data D0 to D2 are respectively supplied to the gate terminals, and transistors in which gradation signals P0 to P2 resulting from counting are respectively supplied to the gate terminals are connected to form a comparator circuit. When the gradation signals P0 to P2 are less than the results of reversal of the gradation data D0 to D2, the comparator circuit is placed into a nonconductive state, while when the gradation signals P0 to P2 are equal to the results of reversal of the gradation data D0 to D2, the comparator circuit is placed into a conductive state. As a result, a pulse signal PW can be produced according to the gradation data D0 to D2 to realize a gradation display in a sub-field driving system. Also, the number of the transistors constituting the comparator circuit can be significantly decreased, as compared with a related art technique.

11 Claims, 7 Drawing Sheets

ELECTROOPTIC DEVICE AND ELECTRONIC APPARATUS

BACKGROUND OF THE INVENTION

1. Field of Invention

The present invention relates to a comparator circuit, a pulse-width modulation circuit, an electrooptic device, and an electronic apparatus suitable for application to various information displays.

2. Description of Related Art

Electrooptic devices, for example, liquid crystal display devices that each include a liquid crystal as an electrooptic material are widely used as display devices for display sections of various information processing apparatuses, liquid crystal televisions, etc. instead of cathode ray tubes (CRT). A related art electrooptic device requires a main body unit (for example, personal computer) which constantly supplies image signals for display because the electrooptic device itself cannot store information. This technique causes the main body unit to continuously output the same image signal for displaying a static image in the electrooptic device. Even when a moving image is displayed, in many cases, gradation data is only changed in a part of pixels in a frame period. Therefore, when the main body unit continuously outputs image signals over the entire screen, electric power is wasted.

Thus, the inventors proposed an electrooptic device including a memory with a few bits provided for each of pixels so that gradation data of each pixel is maintained for each pixel, and image display is continued even when no image signal is input from the outside, as disclosed in Japanese Application No. 2000-270424. This prior application was not laid open to public inspection at the time that this application was filed. In the electrooptic device of the prior application, 8-gradation data is stored in a 3-bit memory for each of the pixels. Also, a so-called sub-field driving system is used as a driving system. Namely, either an on-state potential VH or off-state potential VL is applied to a liquid crystal layer, and the duty ratio of the on-state potential VH is set according to the gradation data.

In the prior application, the duty ratio of the on-state potential VH is set according to the gradation data, and thus gradation signals resulting from cyclic counting of predetermined clock pulses in a certain range (for example, "0" to "7") are supplied to each of the pixels. Also, a comparator is provided on each of the pixels in order to compare the gradation data and the gradation signals. If the count values of the gradation signals are less than the gradation data stored in the memory, the on-state potential VH is selected as the potential applied to the liquid crystal layer. If the count values of the gradation signals exceed the gradation data stored in the memory, the off-state potential VL is selected. In this construction, the effective value of the applied voltage can be set according to the gradation data to permit a gradation display. The cycle of the clock pulses is not constant, and is appropriately changed to compensate the nonlinearity of a liquid crystal.

SUMMARY OF THE INVENTION

In the prior application, the comparator to compare the count result and the gradation data is required, and thus several gate circuits are required to form the comparator. For example, in the prior application, two 2-input OR circuits, one 3-input OR circuit, one each of 2-input, 3-input and 4-input AND circuits are used to constitute the 3-bit comparator. When one transistor is required for one input of each gate, at least 15 transistors are required to form the comparator.

Furthermore, when the bit number of gradation data is "4" or more, the number of necessary transistors significantly increases.

This results in the problem of increasing the power consumption due to the charge and discharge current accompanying the load capacity of the transistors. There is also the problem of making it difficult to physically arrange the transistors and failing to further enhance definition and gradation.

The present invention addresses the above-described situation, and provides a comparator circuit, a pulse-width modulation circuit, an electrooptic device and an electronic apparatus capable of decreasing the number of the transistors used to realize low power consumption, high definition and multi-gradation of an electrooptic device, and the like.

In order to address the above problems, the present invention has the following construction. In the description below, examples are placed in parentheses.

An electrooptic device of the present invention includes a plurality of pixels to perform a gradation display according to the level of a supplied driving signal, a pixel electrode provided for each of the pixels, a memory to store n-bit (n being a natural number of 2 or more) gradation data of each of the pixels, a pulse-width modulation circuit that includes a comparator circuit to compare the gradation data stored in the memory and n-bit gradation signals and a latch circuit to output the driving signal from the latch circuit, and a switching circuit to apply either a voltage to turn on each of the pixels or a voltage to turn off each of the pixels to the pixel electrode according to the driving signal level.

In the electrooptic device of the present invention, the comparator circuit includes n first switching elements (transistors) respectively switched according to the n-bit gradation data and connected in series between first and second terminals, and n second switching elements (transistors) respectively switched according to the n-bit gradation signals successively updated and respectively connected in parallel to the n first switching elements. The conductive/nonconductive state between the first and second terminals is controlled according to the gradation data and the gradation signals, and the results of comparison between the gradation data and the gradation signals are output to the latch circuit.

In the electrooptic device of the present invention, the pulse-width modulation circuit (gradation control circuit) includes the comparator circuit, and the latch circuit which is set to a first state (pulse signal PW=H level) when a first signal (L level) is input, and a second state (pulse signal PW=L level) when a second signal (H level) is input, and to which the first signal is input when the comparator circuit is in the conductive state. The second signal is input to the latch circuit within a predetermined reset period (field period), the count results obtained by counting up or counting down several times without the reset period are supplied as the gradation signals (P0 to P2) to the comparator circuit, and the conductive/nonconductive state between the first and second terminals (terminals) of the comparator circuit is controlled according to the results of comparison between the gradation data (Q0 to Q2) and the gradation signals to set the ratio of the time required for the latch circuit to maintain the first state to the time required for the latch circuit to maintain the second state without the reset period.

In the electrooptic device of the present invention, the pulse-width modulation circuit (gradation control circuit) further includes a third switching element (transistor) to supply the second signal (H level) to the latch circuit in the conductive state, and a fourth switching element (transistor) to supply the first signal (L level) to the comparator circuit in the conductive state. The third switching element is set to the conductive state when the predetermined reset signal (/RES) is in a reset command state (L level), and the fourth switching element is set to the conductive state when the reset signal is in a non-reset command state.

The electrooptic device of the present invention further includes a signal generating circuit to set the reset signal (/RES) to the reset command state (L level) at the beginning of the reset period (field period), and then to set the reset signal to the non-reset command state (H level) and to output the count results obtained by counting up or counting down several times as the gradation signals (P0 to P2).

In the above construction, each of the pixels includes the pixel electrode, the memory (memory cells), the pulse-width modulation circuit (gradation control circuit), and the switching circuit, the pixels being formed on element substrate that includes a transparent substrate and a semiconductor thin film deposited thereon.

Furthermore, each of the pixels includes the pixel electrode, the memory (memory cells) the pulse-width modulation circuit (gradation control circuit), and the switching circuit, the pixels being formed on a single crystal silicon substrate.

The single crystal silicon substrate is a SOI substrate that includes an insulating substrate and a single crystal silicon layer formed thereon.

Furthermore, the memory (memory cells), the pulse-width modulation circuit (gradation control circuit), and the switching circuit are provided opposite to the observation side with respect to the pixel electrode.

The electrooptic device further includes an element substrate on which the pixels are formed, a counter substrate provided with a counter electrode to which a predetermined reference voltage is applied, and a liquid crystal sandwiched between the element subsrtate and the counter substrate.

An electronic apparatus of the present invention includes the above-described electrooptic device.

DETAILED DESCRIPTION OF PREFERRED EMBODIMENTS

1. Principle of Operation of Embodiment

In order to facilitate understanding of a device according to an embodiment of the present invention, the method of driving an electrooptic device according to an embodiment of the present invention is described below.

Figure 4:
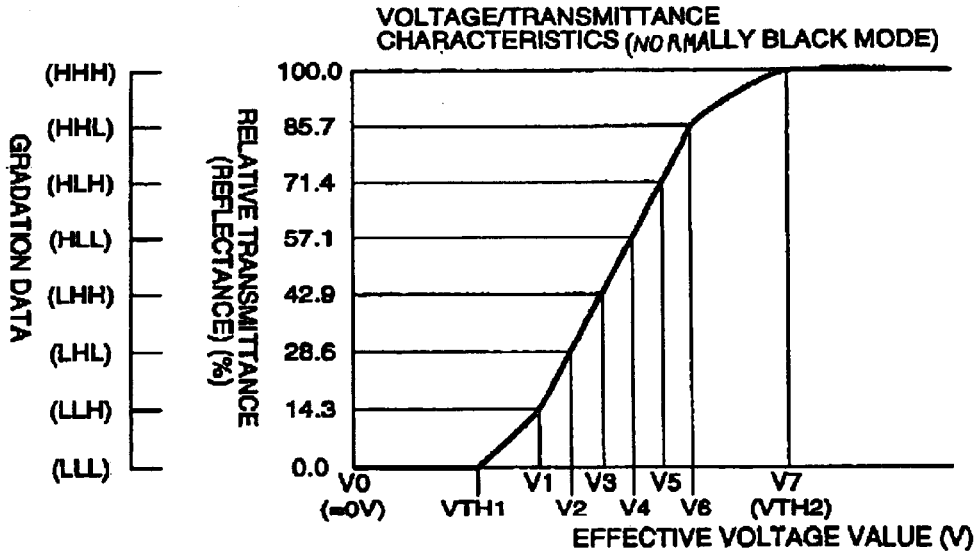
FIG. 4 is a chart showing the voltage/transmittance characteristics of a liquid crystal 137 of the embodiment of the present invention.

In a liquid crystal device using a liquid crystal as an electrooptic device, in general, the relationship between the value of the effective voltage applied to the liquid crystal and relative transmittance (in a reflective liquid crystal device, reflectance) is such as is shown in FIG. 4. FIG. 4 shows a normally black mode as an example in which a black display is performed with no voltage applied. The relative transmittance (reflectance) is represented by a value normalized assuming that the minimum and maximum values of the quantity of transmitted (reflected) light are 0% and 100%, respectively. As shown in FIG. 4, the transmittance of the liquid crystal is 0% when the voltage applied to the liquid crystal layer is less than threshold value VTH1, while the transmittance nonlinearly increases with the applied voltage when the applied voltage is threshold value VTH1 to saturation voltage VTH2.

When the applied voltage is saturation voltage VTH2 or more, the transmittance of the liquid crystal is kept constant regardless of the applied voltage.

In order to set the transmittance of the liquid crystal to an intermediate value between 0% to 100%, an effective voltage corresponding to the transmittance with a voltage between VTH1 and VTH2 in the voltage/transmittance characteristics shown in FIG. 4 must be applied to the liquid crystal layer. In an analog driving system, a voltage to obtain such intermediate gradation is produced by an analog circuit, such as a D/A conversion circuit, an operational amplifier, or the like, and is applied to the pixel electrodes. However, the voltage applied to the pixel electrodes by this driving method is readily affected by variations in the characteristics of the analog circuit, various wiring resistances, and the like, and the voltages applied to the respective pixels are readily made nonuniform, thereby causing difficulty in performing a high-quality and high-definition gradation display.

Therefore, in the electrooptic device of this embodiment, the pixels are driven by the following method. First, one field (1F) is divided into a plurality of sub-fields, and a voltage is applied to the liquid crystal layer by the sub-field unit. In each of the sub-fields, either voltage VH or VL (=0 V) is applied to the liquid crystal layer. Voltage VH is set so that when voltage VH is applied to the liquid crystal layer over one field, the value of the effective voltage applied to the liquid crystal layer in the one field is voltage V7 or more showing in FIG. 4.

Furthermore, the sub-field to which voltage VH is applied, and the sub-field to which voltage VL is applied are determined according to the gradation data so that the ratio of the time required to apply voltage VH in one field to the time required to apply voltage VL (=0 V) is a value according to the gradation data. Consequently, the effective value according to the gradation data can be applied to the liquid crystal layer to permit a display with intermediate gradation between transmittance 0% and 100%. The specified time length for each of the sub-fields will be described below. In each of the embodiments described below, 8-gradation display is performed according to 3-bit gradation data D0, D1 and D2, but, of course, application of the present invention is not limited to this.

2. Construction of Embodiment 2.1. Overall Construction

Figure 1:
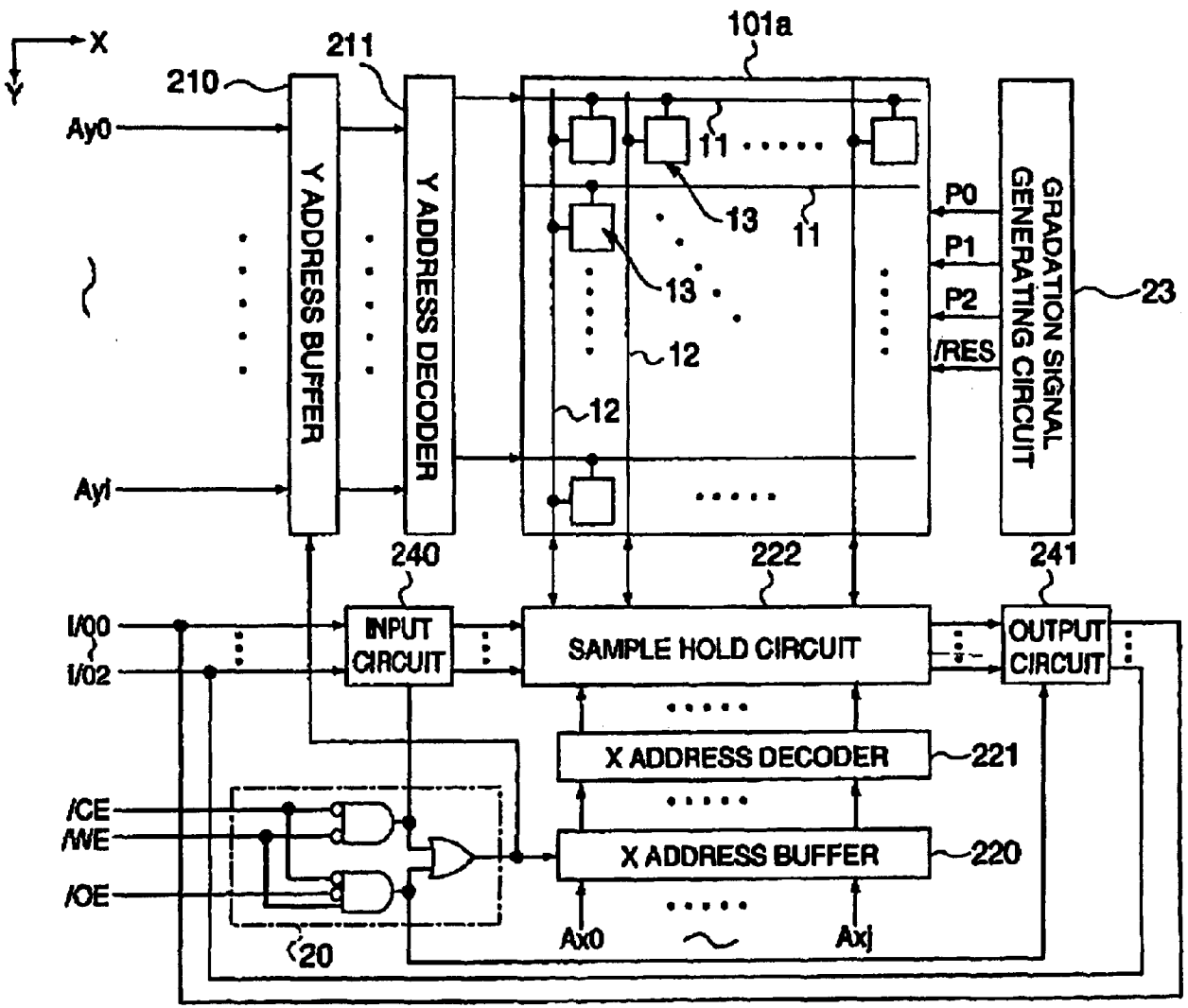
FIG. 1 is a schematic showing the electrical configuration of an electrooptic device according to an embodiment of the present invention.

FIG. 1 is a schematic showing the electrical configuration of the electrooptic device of this embodiment. The electrooptic device is a liquid crystal device using a liquid crystal as an electrooptic material, and including an element substrate and a counter substrate which are bonded together with a predetermined space therebetween, the liquid crystal as the electrooptic material being held in the space. In the electrooptic device, a transmissive semiconductor substrate including TFTs formed by depositing a semiconductor thin film on a glass or quartz amorphous substrate is used as the element substrate, and a pixel circuit to control display of each pixel, and a peripheral driving circuit to control the pixel circuits are formed by MOS transistors formed on the element substrate. FIG. 1 shows the configuration of the circuits formed on the element substrate.

As shown in FIG. 1, in a display area 101*a* on the element substrate, a plurality of row selection lines 11 are formed to extend along the X (row) direction, and a plurality of column selection lines 12 are formed to extend along the Y (column) direction. The pixels 13 are provided in correspondence with the respective intersections of the row selection lines 11 and the column selection lines 12, and arranged in a matrix. The total number of the row selection lines 11 is m, and the total number of the column selection lines 12 is n (m and n are each an integer of 2 or more). Although FIG. 1 shows the configuration in which m pixels 13 in one column are connected to one column selection line 12 in order to prevent complexity of the drawing, the column selection line 12 shown in FIG. 1 actually includes a plurality of column selection lines (as described in detail below).

The electrooptic device further includes an operation control circuit 20, a Y address buffer 210, a Y address decoder 211, an X address buffer 220, an X address decoder 221, a sample hold circuit 222, a gradation signal generating circuit 23, an input circuit 240, and an output circuit 241. The operation control circuit 20 produces an internal control signal corresponding to an operation mode on the basis of a chip enable signal /CE, a write enable signal /WE and an output enable signal /OE supplied from host devices not shown in FIG. 1.

The specific configuration of the operation control circuit 20 is shown in FIG. 1. In the configuration, when the chip enable signal /CE and the write enable signal /WE are the L level, an H-level enable signal is supplied to the Y address buffer 210, the X address buffer 220 and the input circuit 240. As a result, the operation mode of the electrooptic device is transferred to a write mode to write the gradation data D0 to D2 supplied from a host device through data input/output terminals I/O0 to I/O2 in each of the pixels 13.

On the other hand, when the chip enable signal /CE and the output enable signal /OE are the L level, and the write enable signal /WE is the H level, an H-level enable signal is supplied to the Y address buffer 210, the X address buffer 220 and the output circuit 241. As a result, the operation mode is transferred to a read mode to read the data written in each of the pixels 13 and to output the read data to the outside through the data input/output terminals I/O0 to I/O2.

The input circuit 240 and the output circuit 241 are connected to the data input/output terminals I/O0 to I/O2. When the H-level enable signal is supplied from the operation control circuit 20, the input circuit 240 is placed into an operation state to output the gradation data D0 to D2 input through the input/output terminals I/O0 to I/O2 to the sample hold circuit 222. The gradation data D0 to D2 are digital data at the H level or L level. When the H-level enable signal is supplied from the operation control circuit 20, the output circuit 241 is placed into an operation state to output the gradation data D0 to D2, which are read from the pixels 13 by the sample hold circuit 222, to the input/output terminals I/O0 to I/O2.

Furthermore, Y address signals Ay0 to Ayi are supplied to the Y address buffer 210 from a host device not shown in FIG. 1. When the H-level enable signal is supplied from the operation control circuit 20, the Y address buffer 210 is placed into an operation state to output the supplied Y address signals Ay0 to Ayi to the Y address decoder 211.

The input terminals of the Y address decoder 211 are respectively connected to the output terminals of the Y address buffer 210, and the output terminals of the Y address decoder 211 are respectively connected to ends (the left ends in FIG. 1) of the row selection lines 11. The Y address decoder 211 decodes the Y address signals Ay0 to Ayi output from the Y address buffer 210 to selectively output an H-level Y selection signal to one of the plurality of row selection lines 11 connected thereto. As a result, the row selection line 11 is selected according to the Y address signals Ay0 to Ayi.

On the other hand, X address signals Ax0 to Axj are supplied to the X address buffer 220 from a host device not shown in FIG. 1. When the H-level enable signal is supplied from the operation control circuit 20, the X address buffer 220 is placed into an operation state to output the supplied X address signals Ax0 to Axj to the X address decoder 221. The input terminals of the X address decoder 221 are respectively connected to the output terminals of the X address buffer 220, and the output terminals of the X address decoder 221 are respectively connected to input terminals of the sample hold circuit 222. The X address decoder 221 decodes the X address signals Ax0 to Axj output from the X address buffer 220 to produce an X selection signal. The X selection signal is a signal to select the column selection line 12 from the plurality of column selection lines 12 according to the X address signals Ax0 to Axj.

The sample hold circuit 222 outputs the gradation data D0, D1 and D2 supplied from the input circuit 240 to the column selection line 12 specified by the X selection signal output from the X address decoder 221. In this configuration, in the write mode, the gradation data D0, D1 and D2 output from the input circuit 240 are supplied to the pixel 13 corresponding to the intersection of the row selection line 11 to which the Y selection signal produced by the Y address decoder 211 is output, and the column selection line 12 specified by the X selection signal produced by the X address decoder 221.

In this embodiment, a voltage to turn on the pixel 13 or a voltage to turn off the pixel 13 is applied to the pixel 13 at a time density corresponding to the gradation data D0 to D2 and the gradation signals P0 to P2 (described in detail below). The gradation signal generating circuit 23 is a circuit to generate the gradation signals P0, P1 and P2 and the reset signal /RES and to output these signals. Each of the gradation signals P0, P1 and P2 is the H level for a predetermined time for each of the fields. This is described in detail below.

In this embodiment, one field is divided into seven sub-fields, and the pixels are turned on or off by the sub-field unit to realize an 8-gradation display according to the 3-bit gradation data. The mode to apply the voltage to each of the pixels, and the time length of each of the sub-fields SF1 to SF7 are as follows. For example, when gradation data (LLH) are supplied to a pixel, i.e., when a gradation display is performed with the pixel transmittance of 14.3% in FIG. 4, voltage VH is applied to the liquid crystal layer for the pixels in sub-field SF1 of one field (1F), while voltage VL (=0 V) is applied to the liquid crystal layer in the other sub-fields SF2 to SF7. In this case, the effective voltage value can be determined from the square root of an average of the squares of voltage instantaneous values over one period (one field). Therefore, if the time of the sub-field SF1 is set to (V1/VH)2 based on one field (1F), the value of the effective voltage applied to the liquid crystal layer in one field (1F) by applying the above voltage is V1.

For example, when gradation data (LHL) are applied to a pixel, i.e., when a gradation display is performed with a pixel transmittance of 28.6%, voltage VH is applied to the liquid crystal layer for the pixels in sub-fields SF1 and SF2 of one field (1F), while voltage VL is applied to the liquid crystal layer in the other sub-fields SF3 to SF7. In this case, if the time of the sub-fields SF1 and SF2 is set to (V2/VH) 2 based on one field (1F), the value of the effective voltage applied to the liquid crystal layer in one field (1F) by applying the above voltage is V2. As described above, the time of sub-field SF1 is set to (V1/VH) 2, and thus the time of sub-field SF2 may be set to (V2/VH) 2−(V1/VH) 2.

Similarly, for example, when gradation data (LHH) are applied to a pixel, i.e., when a gradation display is performed with a pixel transmittance of 42.9%, voltage VH is applied to the liquid crystal layer for the pixels in sub-fields SF1 to SF3 of one field (1F), while voltage VL is applied to the liquid crystal layer in the other sub-fields SF4 to SF7. In this case, if the time of the sub-fields SF1 to SF3 is set to (V3/VH) 2 based on one field (1F), the value of the effective voltage applied to the liquid crystal layer in one field (1F) by applying the above voltage is V3. As described above, the time of sub-fields SF1 and SF2 is set to (V2/VH) 2, and thus the time of sub-field SF3 may be set to (V3/VH) 2−(V2/VH) 2.

Similarly, the time of each of sub-fields SF4 to SF6 is determined. For sub-field SF7, the time is finally set to a value obtained by subtracting the time of sub-fields SF1 to SF6 from the time of one field. However, as described above, it is necessary to maintain the time length of (V7/VH) 2 for one field (1F) as the total time length of sub-fields SF1 to SF7. However, even when the total time length of sub-fields SF1 to SF7 is longer than the time length of (V7/VH) 2 for one field, i.e., even when the value of the effective voltage applied to the liquid crystal layer exceeds V7 shown in FIG. 4, transmittance becomes 100% due to saturation.

Figure 6:
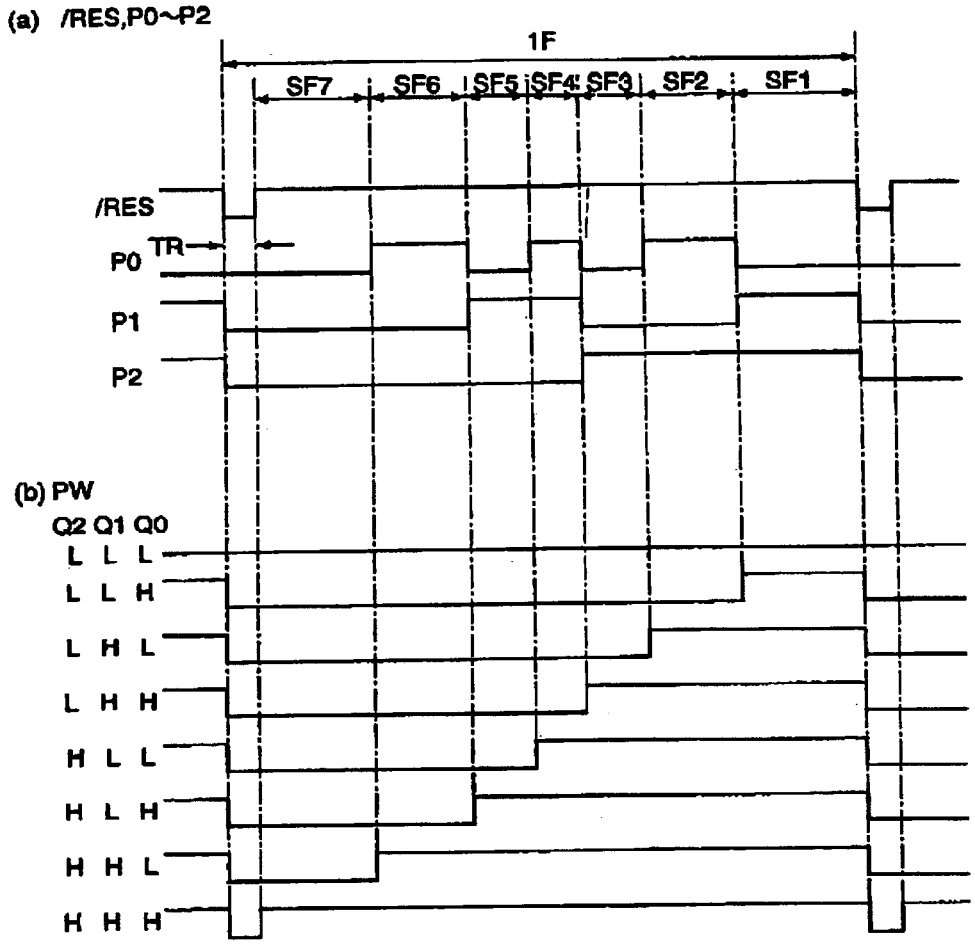
FIGS. 6(*a*) and 6(*b*) are timing charts of a gradation control circuit 138 of the embodiment of the present invention.

FIG. 6(*a*) is a timing chart showing the waveforms of the gradation signals P0 to P2 and the reset signal /RES (described in detail below) in this embodiment. As shown in FIG. 6(*a*), each of the gradation signals is set to either the H level or the L level by the sub-field unit in one field. In this embodiment, as shown in FIG. 6(*a*), as the gradation signals P0 to P2, output signals of a 3-bit counter to count "0" to "6" are used. Namely, in sub-field SF1, the gradation signals P0, P1 and P2 are "L", "H" and "H" levels, respectively, to show count value "6"; in sub-field SF2, the gradation signals P0, P1 and P2 are "H", "L" and "H" levels, respectively, to show count value "5"; in sub-field SF3, the gradation signals P0, P1 and P2 are "L", "L" and "H" levels, respectively, to show count value "4". This is true for the values "0" to "3".

Figure 2:
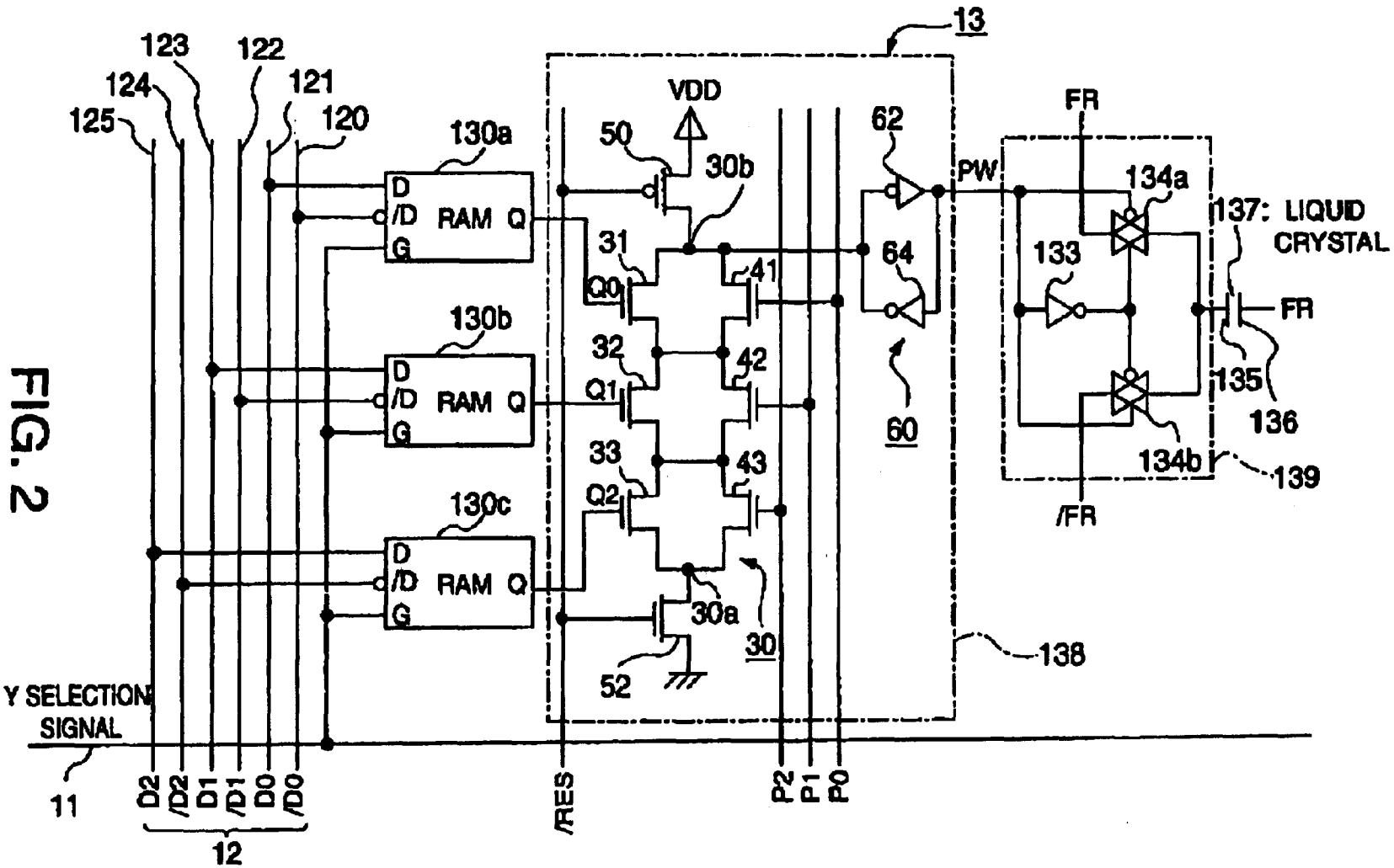
FIG. 2 is a schematic showing the circuit of each pixel 13 in the embodiment of the present invention.

FIG. 2 is a schematic showing the circuit configuration of each pixel 13 of the electrooptic device of this embodiment. As shown in FIG. 2, the pixel circuit of the pixel 13 includes memory cells 130*a*, 130*b* and 130*c*, a gradation control circuit 138, a switching circuit 139, a pixel electrode 135, a counter electrode 136 and a liquid crystal 137. Hereafter, when one of the memory cells 130*a*, 130*b* and 130*c* does not need to be specified, the memory cells are simply denoted as memory cells 130. This is true for the other reference numerals.

Although FIG. 1 shows the configuration in which m pixels 13 in one column are connected to one column selection line 12 in order to prevent complexity of the drawing, more specifically, each of the column selection lines 12 includes column selection lines 120 to 125, as shown in FIG. 2. Thus, the gradation data D0, D1 and D2, and inversion signals /DO, /D1 and /D2 thereof are respectively supplied to the column selection lines 120 to 125.

As shown in FIG. 2, the memory cells 130 are provided in a number (in this embodiment, three) corresponding to the bit number of the gradation data. The column selection lines 120 and 121 are connected to the memory cell 130*a* to supply the gradation data /D0 and D0 to the column selection lines 120 and 121, respectively; the column selection lines 122 and 123 are connected to the memory cell 130*b* to supply the gradation data /D1 and D1 to the column selection lines 122 and 123, respectively; the column selection lines 124 and 125 are connected to the memory cell 130*c* to supply the gradation data /D2 and D2 to the column selection lines 124 and 125, respectively. On the other hand, each of the memory cells 130*a*, 130*b* and 130*c* is also connected to the corresponding row selection line 11 to which the Y selection signal is supplied.

Figure 3:
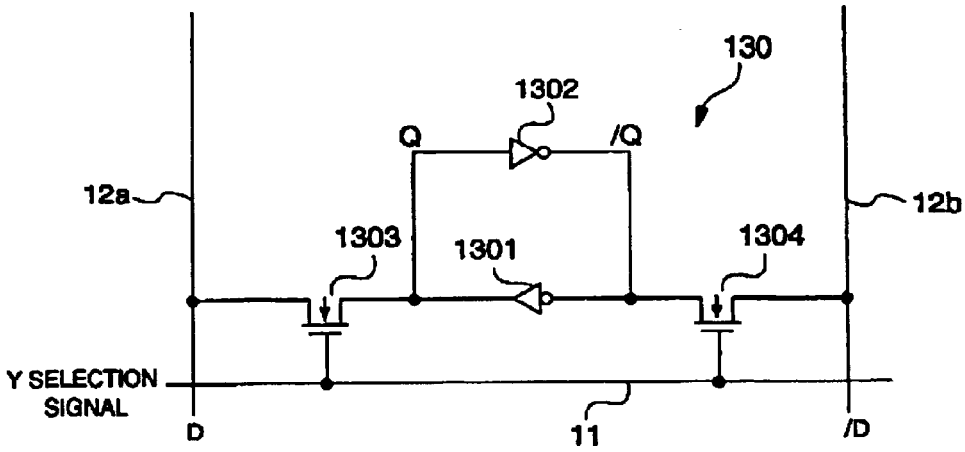
FIG. 3 is a schematic showing the circuit of each memory cell 130 in the embodiment of the present invention.

FIG. 3 is a schematic illustrating the typical configuration of each of the memory cells 130. As shown in FIG. 3, each memory cell 130 has a static memory (SRAM) configuration including inverters 1301 and 1302, and transistors 1303 and 1304.

As shown in FIG. 3, the inverters 1301 and 1302 constitute a flip-flop, i.e., a 1-bit memory, in which the output terminal of one of the inverters is connected to the input terminal of the other. On the other hand, each of the transistors 1303 and 1304 is an N-channel transistor, which is placed into the conductive state during writing in or reading from the 1-bit memory. The drains of the transistors 1303 and 1364 are respectively connected to the input terminals of the inverters 1301 and 1302, and the gates of the transistors 1303 and 1304 are connected to the corresponding row selection line 11 to which the Y selection signal is supplied.

Although FIG. 2 shows the two column selection lines connected to one memory cell 130, the two column selection lines correspond to the two column selection lines 12*a* and 12*b* shown in FIG. 3. The source of the transistor 1303 is connected to the column selection line 12*a*, and the source of the transistor 1304 is connected to the column selection line 12*b*. In this case, any one (denoted by "D" in FIG. 3) of the gradation data D0, D1 and D2 is supplied to the column selection line 12*a*, and the data (denoted by "/D" in FIG. 3) at the inverted level of the gradation data supplied to the column selection line 12*a* is supplied to the column selection line 12*b*.

Each of the memory cells 130 has the above-described configuration in which the transistors 1303 and 1304 are put into the conductive state when the H-level Y selection signal is output to the corresponding row selection line 11. In this state, when the gradation data and the data at the inverted level are supplied to the column selection lines 12*a* and 12*b*, the gradation data is stored in the memory including the inverters 1301 and 1302. The stored data is maintained even when the Y selection signal becomes the L level to place the transistors 1303 and 1304 in the nonconductive state. In the description below, output of the inverter 1301 is referred to as "output Q", and output of the inverter 1302 is referred to as "output /Q".

Again referring to FIG. 2, output Q (gradation data Q0 to Q2) of each memory cell 130 in each pixel 13, and the gradation signals P0, P1, and P2 output from the gradation signal generating circuit 23 are input to the gradation control circuit 138. The gradation control circuit 138 performs arithmetic processing of these input signals to produce a pulse signal PW having a time density corresponding to the gradation data Q0 to Q2 read from each memory cell in one field (1F), and output the pulse signal PW.

On the other hand, the output terminals of transmission gates 134*a* and 134*b* are connected to the pixel electrode 135. The liquid crystal 137 is sandwiched between the pixel electrode 135 and the counter electrode 136 to form the liquid crystal layer. The counter electrode 136 includes a transparent electrode formed over the entire surface of the counter substrate so as to be opposed to the pixel electrode 135 formed on the element substrate. Furthermore, a field reverse driving signal FR is supplied to the counter electrode 136 from a voltage generating circuit not shown in FIG. 2. The field reverse driving signal FR is a signal which repeats level inversion (polarity reversal) from VH to VL or from VL to VH for each one field (1F). With respect to the levels of the field reverse driving signal FR, and the like, VH is referred to as "H level", and VL is referred to as "L level" for convenience of description.

The pulse signal PW output from the gradation control circuit 138 is supplied to the gates of the p-channel transistor of the transmission gate 134*a* and the N-channel transistor of the transmission gate 134*b*. Furthermore, the level of the pulse signal PW is inverted by the inverter 133, and then the pulse signal PW is supplied to the gates of the N-channel transistor of the transmission gate 134*a* and the P-channel transistor of the transmission gate 134*b*. Each of the transmission gates 134*a* and 134*b* is a gate which is placed into the conductive state when an L-level gate signal is supplied to the P-channel transistor, and an H-level gate signal is supplied to the N-channel transistor. Therefore, one of the transmission gates 134*a* and 134*b* is placed into the conductive state, and the other is placed into the nonconductive state according to the level of the pulse signal PW. The input terminal of the transmission gate 134*a* is connected to wiring to which the field reverse driving signal FR is supplied, while the input terminal of the transmission gate 134*b* is connected to wiring to which a signal /FR is supplied. The signal /FR is a signal at the reversed level of the field reverse driving signal FR. Namely, with the field reverse driving signal FR at the H level (=VH), the signal /FR is the L level (=VL), while with the field reverse driving signal FR at the L level (=VL), the signal /FR is the H level. (=VH).

In the above-described configuration, when the H-level pulse signal PW is supplied from the gradation control circuit 138, the transmission gate 134*a* is in the nonconductive state, and the transmission gate 134*b* is in the conductive state. Therefore, the signal /FR is applied to the pixel electrode 135 through the transmission gate 134*b*.

As a result, the voltage difference VH between the potential applied to the pixel electrode 135 and the potential applied to the counter electrode 136 is applied to the liquid crystal layer of the pixel 13 to turn the pixel 13 on. However, when the L-level pulse signal PW is supplied from the gradation control circuit 138, the transmission gate 134*a* is in the conductive state, and the transmission gate 134*b* is in the nonconductive state. Therefore, the field reverse driving signal FR is applied to the pixel electrode 135. As a result, the voltage applied to the liquid crystal layer of the pixel 13 is VL (=0 V), thereby turning the pixel 13 off.

2.2. Configuration of the Gradation Control Circuit 138

The detailed configuration of the gradation control circuit 138 shown in FIG. 2 is now described.

In FIG. 2, reference numerals 31 to 33 respectively denote transistors connected in series, and the gradation data Q0 to Q2 are supplied to the gate terminals of the respective transistors. Namely, with the H-level corresponding gradation data, the transistors 31 to 33 are placed into the conductive state, while with the L-level corresponding gradation data, the transistors 31 to 33 are placed into the nonconductive state. Reference numerals 41 to 43 denote transistors which are connected in series and respectively connected to the transistors 31 to 33 in parallel, and the gradation signals P0 to P2 are respectively supplied to the gate terminals of these transistors. Namely, with the H-level corresponding gradation data, the transistors 41 to 43 are placed into the conductive state, while with the L-level corresponding gradation data, the transistors 41 to 43 are placed into the nonconductive state.

The comparator circuit 30 includes the transistors 31 to 33 and 41 to 43. Reference numeral 52 denotes a transistor connected between a terminal 30*a* of the comparator circuit 30 and the ground potential (0 V), and the reset signal /RES is supplied to the gate terminal of the transistor 52. As a result, with the H-level reset signal /RES, the ground potential (=0 V), i.e., the L-level potential, is applied to the terminal 30*a* of the comparator circuit 30 through the transistor 52.

Reference numeral 50 denotes a transistor connected between the other terminal 30*b* of the comparator circuit 30 and a power supply potential (VDD), and the reset signal /RES is supplied to the gate terminal of the transistor 50. As a result, with the L-level reset signal /RES, the power supply potential (VDD), i.e., the H-level potential, is applied to the terminal 30*b* of the comparator circuit 30 through the transistor 50.

Furthermore, reference numerals 62 and 64 respectively denote inverters which form the latch circuit 60 in which the output terminal of one of the inverters is connected to the input terminal of the other. The latch circuit 60 outputs the maintained value, i.e., the output level of the inverter 62, as the pulse signal PW. When the H-level potential is applied to the terminal 30*b* through the transistor 50, the pulse signal PW becomes the L level. On the other hand, when the L-level potential is applied to the terminal 30*b* through the transistor 52 and the comparator circuit 30, the pulse signal PW becomes the H level. When no voltage is applied to the terminal 30*b* through the transistor 50, the transistor 52 and the comparator circuit 30, the potential of the terminal 30*b* corresponds to the output signal (i.e., the reversed signal of the pulse signal PW) of the inverter 64 to hold the level of the pulse signal PW.

2.3. Configuration of Liquid Crystal Device

Figure 5:
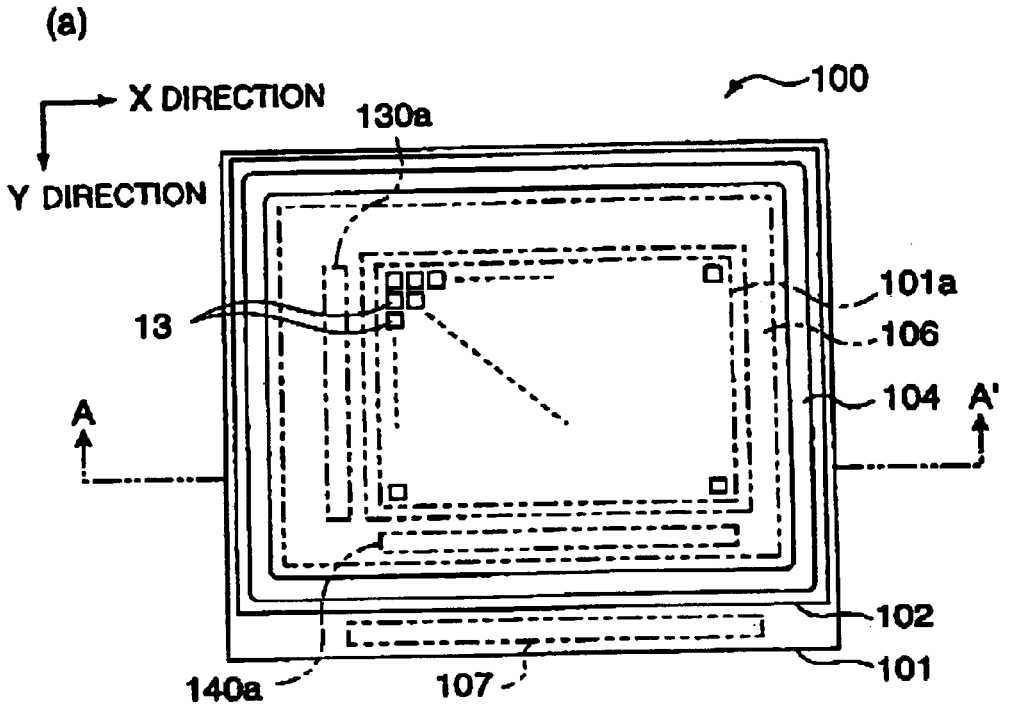
FIGS. 5(*a*) and 5(*b*) are schematics showing the configuration of an electrooptic device of the embodiment of the present invention.
Figure 5:
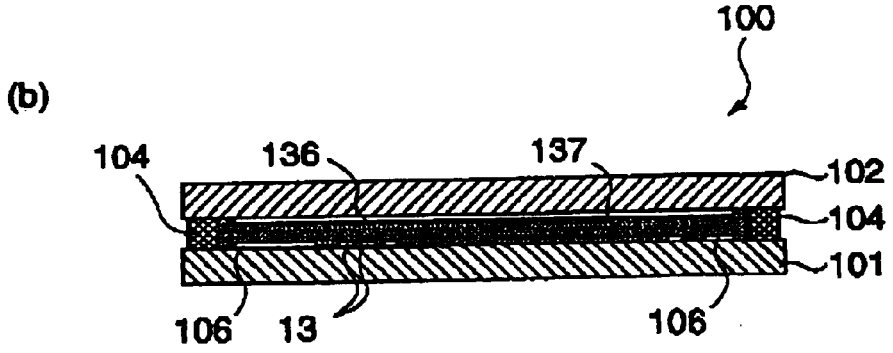

The structure of the electrooptic device is described below with reference to FIGS. 5(*a*) and (*b*). FIG. 5(*a*) is a plan view showing the configuration of an electrooptic device 100, and FIG. 5(*b*) is a sectional view taken along plane A–A' in FIG. 5(*a*). As shown in FIGS. 5(*a*) and 5(*b*), in the electrooptic device 100, an element substrate 101 on which the pixels 13 are formed, and a counter substrate 102 on which the counter electrode 136 is formed are bonded together with a sealing material 104 with a predetermined space therebetween, the liquid crystal 137 as an electrooptic material being held in the space. In fact, the sealing material 104 has a notch portion so that the liquid crystal 137 is sealed in through the notch portion, and then the notch is closed with a sealant. However, the notch portion, the liquid crystal, etc. are not shown in FIGS. 5(*a*) and 5(*b*). Each of the element substrate 101 and the counter substrate 102 is a glass or quartz amorphous substrate. Each of the pixels 13 includes a TFT formed by laminating semiconductor thin films on the element substrate 101. Namely, the electrooptic device 100 is used as a transmissive type.

In the element substrate 101, a light shielding film 106 is provided between the sealing material 104 and the display area 101*a*. In the region where the light shielding film 106 is formed, for example, the Y address buffer 210, the Y address decoder 211, and the like are formed in a region 130*a*, and the X address buffer 220, the X address decoder 221 and the sample hold circuit 222, and the like are formed in a region 140*a*. Namely, the light shielding film 106 reduces or prevents light incidence on the driving circuits formed in the region. In this construction, the field reverse driving signal FR is applied to the light shielding film 106 as well as the counter electrode 136. Therefore, in the region where the light shielding film 106 is formed, the voltage applied to the liquid crystal layer is substantially zero, and the same display state as the pixel electrodes 135 with no voltage applied is obtained.

In the element substrate 101, in a region 107 outside the region 140*a*, the region 107 being separated from the region 140*a* by the sealing material 104, a plurality of connecting terminals are formed to input a control signal, a power supply, etc. from the outside.

On the other hand, the counter electrode 136 of the counter substrate 102 is electrically connected to the light shielding film 106 and the connecting terminals on the element substrate 101 through a conductive material (not shown in FIGS. 5(*a*) and 5(*b*)) provided at least one position of the four corners of the substrate bonded portion. Namely, the field reverse driving signal FR is applied to the light shielding film 106 through the connecting terminals provided on the element substrate 101, as well as to the counter elector 136 through the conductive material.

Furthermore, in the counter substrate 102, for example, in a direct viewing type, a color filter arranged in a stripe, mosaic, or triangle form, or the like is first provided, and a light fielding film (black matrix) made of, for example, a metal material or a resin is secondary provided according to application of the electrooptic device 100. In application to colored light modulation, for example, when the electrooptic device 100 is used as a light value of the projector described below, the color filter is not formed. In the direct viewing type, a front light to irradiate the electrooptic device 100 with light from the counter substrate 102 side, or a back light to irradiate light from the element substrate 101 side is provided as required. In addition, an alignment film (not shown in FIGS. 5(*a*) and 5(*b*)) which is rubbed in a predetermined direction, is provided on the electrode formation surface of each of the element substrate 101 and the counter substrate 102 to define the orientation direction of liquid crystal molecules with no voltage applied. Also, a polarization plate (not shown in FIGS. 5(*a*) and (*b*)) is provided on each of the element substrate 101 and the counter substrate 102 according to the orientation direction. However, when a polymer dispersion type liquid crystal comprising fine particles dispersed in a polymer is used as the liquid crystal 137, the alignment film and the polarization plate are unnecessary to enhance the efficiency of light utilization, thereby causing effectiveness from the viewpoint of increasing luminance and decreasing power consumption.

3. Operation of Embodiment 3.1. Operation of the Gradation Control Circuit 138

Next, the operation of the electrooptic device of this embodiment is described with reference to FIG. 6.

It is first assumed that the gradation data Q2, Q1 and Q0 are "L", "L" and "L" levels, respectively. In one field (1F) shown in FIG. 6(*a*), when a predetermined reset period TR is first started, the reset signal /RES falls from the H level to the L level. In the reset period TR, the transistor 50 is in the conductive state, and the transistor 52 is in the nonconductive state, thereby applying the H-level potential to the terminal 30*b* through the transistor 50. Consequently, the pulse signal PW is set to the L level.

Next, in the sub-field SF7, the transistor 50 is in the nonconductive state, and the transistor 52 is in the conductive state, thereby applying the L-level potential to the terminal 30*b* when the comparator circuit 30 is placed in the conductive state. On the assumption that the gradation data Q2, Q1 and Q0 are "L", "L" and "L" levels, respectively, the transistors 31 to 33 are always placed into the nonconductive state. Therefore, only when all of the transistors 41 to 43 are placed into the conductive state, the comparator circuit 30 is entirely placed into the conductive state.

However, as shown in FIG. 6(*a*), the gradation signals P0 to P2 are the results of counting from "0" to "6", and thus there is no timing with which all values of the gradation signals P0 to P2 are the H level. Consequently, in the one field, the level (L level) of the pulse signal PW first set in the reset period TR is maintained.

Next, it is assumed that the gradation data Q2, Q1 and Q0 are "H", "H" and "L" levels, respectively. As described above, in one field shown in FIG. 6(*a*), the reset period TR is first provided, and the pulse signal PW is set to the L level. After the reset period TR, on the assumption that the gradation data Q2, Q1 and Q0 are "H", "H" and "L" levels, respectively, the transistors 32 and 33 are always in the conductive state, and the transistor 31 is always in the nonconductive state. Therefore, when the transistor 41 is placed into the conductive state, the comparator circuit 30 is entirely placed into the conductive state regardless of the states of the transistors 42 and 43.

In other words, when the condition in which the gradation signals P2, P1 and P0 are "X", "X" and "H" levels ("X" represents "indefinite"), respectively, is satisfied, the comparator circuit 30 is entirely placed into the conductive state. Since the gradation signals P2, P1 and P0 are the count results obtained by increments of "1" each from the initial value "0", "X" is "L" when the condition is first satisfied, i.e., at the start timing of sub-field SF6 at which the gradation signals P2, P1 and P0 are "L", "L", and "H" level, respectively.

When the comparator circuit 30 is placed into the conductive state at the start of sub-field SF6, the potential of the terminal 30*b* is forcibly set to the L level, and the pulse signal PW is set to the H level through the inverter 62. Then, the potential at the terminal 30*b* is maintained at the L level through the inverter 64, and the pulse signal PW is maintained at the H level. In the subsequent sub-fields SF5 to SF1, the condition in which the gradation signals P2, P1 and P0 are "X", "X", and "H" level, respectively, is satisfied in some cases. However, once the potential of the terminal 30*b* is set to the L level, the conductive/nonconductive state of the comparator circuit 30 has no influence on the data held in the latch circuit 60, and the potential of the terminal 30*b* is maintained until the potential is again set to the H level through the transistor 50 at the start of a next field.

Even when the gradation data Q2, Q1 and Q0 are other values, the operation is the same as described above. Namely, the timing with which in one field, the comparator circuit 30 is first set to the conductive state according to any of the gradation data Q2, Q1 and Q0 is timing with which the gradation signals P2, P1 and P0 become reversed signals of the gradation data Q2, Q1 and Q0. As shown in FIG. 6(*b*), the timing becomes later as the values of the gradation data Q2, Q1 and Q0 decrease. Once the comparator circuit 30 is placed into the conductive state, and the pulse signal PW is set to the H level, the level of the pulse signal PW is kept constant until the next field is started regardless of the subsequent state of the comparator circuit 30. It is thus found that the duty ratio at which the pulse signal PW becomes the H level changes according to the gradation data Q2, Q1 and Q0.

3.2. Overall Operation

Next, the overall operation of this embodiment is described. First, in the write mode, the gradation data are written in the memory of the pixels 13. For the sake of convenience of description, the operation of supplying the gradation data D0 to D2 to the memory in one pixel is described below. First, when the L-level chip enable signal /CE and the write enable signal /WE are supplied from a host device not shown in FIGS. 6(*a*) and 6(*b*), the write mode is established, and the operation to write the gradation data in the pixel 13 is executed in each of the sections of the electrooptic device.

In the Y address decoder 211, the Y address signals Ay0 to Ayi supplied through the Y address buffer 210 are decoded to output the H-level Y selection signal to the row selection line 11 specified by the Y address signals Ay0 to Ayi. On the other hand, in the X address decoder 221, the X address signals Ax0 to Axj supplied through the X address buffer 220 are decoded to produce and output the X selection signal.

When the H-level enable signal is supplied from the operation control circuit 20, the input circuit 240 is placed into the operating state. As a result, the gradation data D0 to D2 supplied from a host device through the data input/output terminals I/O0 to I/O2 are output to the sample hold circuit 222. The sample hold circuit 222 outputs the gradation data D0 to D2 supplied from the input circuit 240 to the column selection line 12 specified by the X selection signal output from the X address decoder 221.

In this state, the transistors 1303 and 1304 (refer to FIG. 3) in each memory cell 130 provided in the pixel 13 in which data is to be written are put into the conductive state by the H-level Y selection signal, and the gradation data D0 to D2 output from the sample hold circuit 222 are respectively written in the memory cells 130*a*, 130*b* and 130*c* of the pixel 13.

When the gradation data D0 to D2 are respectively written in the memory cells 130, and maintained therein, the written data are output as the gradation data Q0 to Q2. As described above, the gradation control circuit 138 produces the H-level or L-level pulse signal PW according to the gradation data Q0 to Q2 and the gradation signals P0 to P2, and outputs the pulse signal PW. In the period in which the pulse signal PW is the H level, the voltage to turn on the pixel is applied to the liquid crystal layer of the pixel, while in the period in which the pulse signal PW is the L level, the voltage to turn off the pixel is applied to the liquid crystal layer of the pixel.

4. Examples of Electronic Apparatus 4.1. Projector

Examples of electronic apparatuses using the above-described electrooptic device will be described. First, a projector 5400 as a projection display device using the electrooptic device of the embodiment as a light valve is described.

Figure 7:
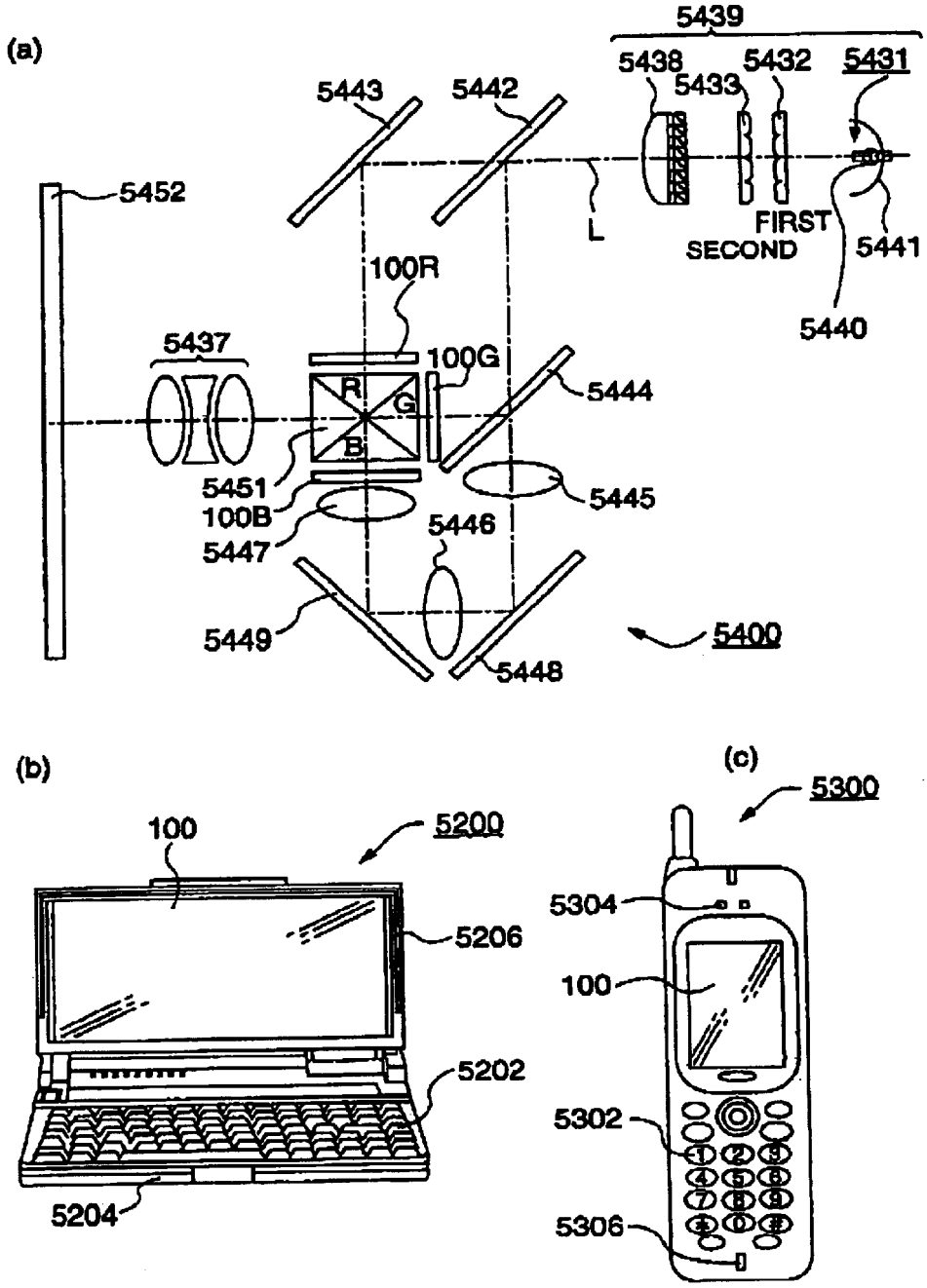
FIGS. 7(*a*)–7(*c*) are schematics showing various electronic apparatuses to which the electrooptic device of the embodiment is applied.

FIG. 7(*a*) is a schematic showing the principal portion of a projection display device. In FIG. 7(*a*), reference numeral 5431 denotes a light source, 5442 and 5444 each denote a dichroic mirror, 5443, 5448 and 5449 each denote a reflecting mirror, 5445 denotes a incidence lens, 5446 denotes a relay lens, 5447 denotes an emission lens, 100R, 100G and 100B each denote a liquid crystal light modulation device including the electrooptic device, 5451 denotes a crossed dichroic prism, and 5437 denotes a projection lens. The light source 5431 includes a lamp 5440 of metal halide or the like, and a reflector 5441 to reflect light of the lamp. The blue light and green light reflecting dichroic mirror 5442 transmits red light of a light flux from the light source 5431, and reflects blue light and green light. The transmitted red light is reflected by the reflection mirror 5443 and incident on the liquid crystal light modulation device 100R for red light. On the other hand, green light of color light reflected by the dichroic mirror 5442 is reflected by the dichroic mirror 5444 for green light reflection, and incident on the liquid crystal light modulation device 100G for green light.

On the other hand, blue light is transmitted through the second dichroic mirror 5444. For the blue light, a light guide device including a relay lens system including the incidence lens 5445, the relay lens 5446 and the emission lens 5447 is provided to prevent a light loss due to a long optical path so that the blue light is incident on the liquid crystal light modulation device 100B for blue light through the light guide device. Three color lights modulated by the light modulation devices are incident on the crossed dichroic prism 5451. This prism includes four right-angle prisms bonded together, and a dielectric multilayer film and a dielectric multilayer film to reflect blue light, which are formed in a crucial form on the inner surfaces of the four prisms. The three color lights are combined by the dielectric multilayer films to form light to display a color image. The synthetic light is projected on a screen 5452 through the projection lens 5437 of projection optical system to diplay an enlarged image.

4.2. Mobile Computer

An example in which the electrooptic device is applied to a mobile personal computer is described. FIG. 7(*b*) is a front view showing the construction of a personal computer. In FIG. 7(*b*), a mobile computer 5200 includes a main body 5204 provided with a keyboard 5202, and a display unit 5206.

The display unit 5206 includes the above-described electrooptic device 100, and a back light added to the back thereof.

4.3. Cell Phone

Another example in which the electrooptic device is applied to a cell phone is described. FIG. 7(*c*) is a front view showing the construction of a cell phone. A cell phone 5300 includes a plurality of operation buttons 5302, an ear piece 5304, a mouth piece 5306, and the electrooptic device 100. In the electrooptic device 100, a back light is provided on the back as required.

4.4. Others

Besides the above electronic apparatuses, examples of electronic apparatuses include a liquid crystal television, a view finder-type or monitor direct-viewing-type video tape recorder, a car navigation device, a pager, an electronic notebook, an electric calculator, a word processor, a work station, a video phone, a POS terminal, apparatuses comprising a touch panel, and the like, for example. Of course, the above-described electrooptic device can be applied to these various and other electronic apparatuses.

5. Modified Embodiments

The present invention is not limited to the above-described embodiment, and for example, the various modifications can be made as described below.

(1) Although, in the above embodiment, the bit numbers of the gradation data D0 to D2 (Q0 to Q2) and the gradation signals P0 to P2 are set to "3" to perform a diplay of 23=8 gradations, the bit numbers of the gradation data and the gradation signals may be changed according to the number of necessary gradations. Namely, when the gradation signals are count results obtained by increments of "1" each from the initial value of "0", the timing with which the comparator circuit 30 is first placed into the conductive state is the timing with which the gradation signals become the reversed signals of the gradation data. Therefore, the pulse signal PW can be raised with the timing according to the gradation data regardless of the bit numbers of the gradation signals and the gradation data. Although, in the embodiment, the gradation signals P0 to P2 are produced by counting up the predetermined pulse signal, the gradation signals P0 to P2 may be produced by counting down.

Figure 8:
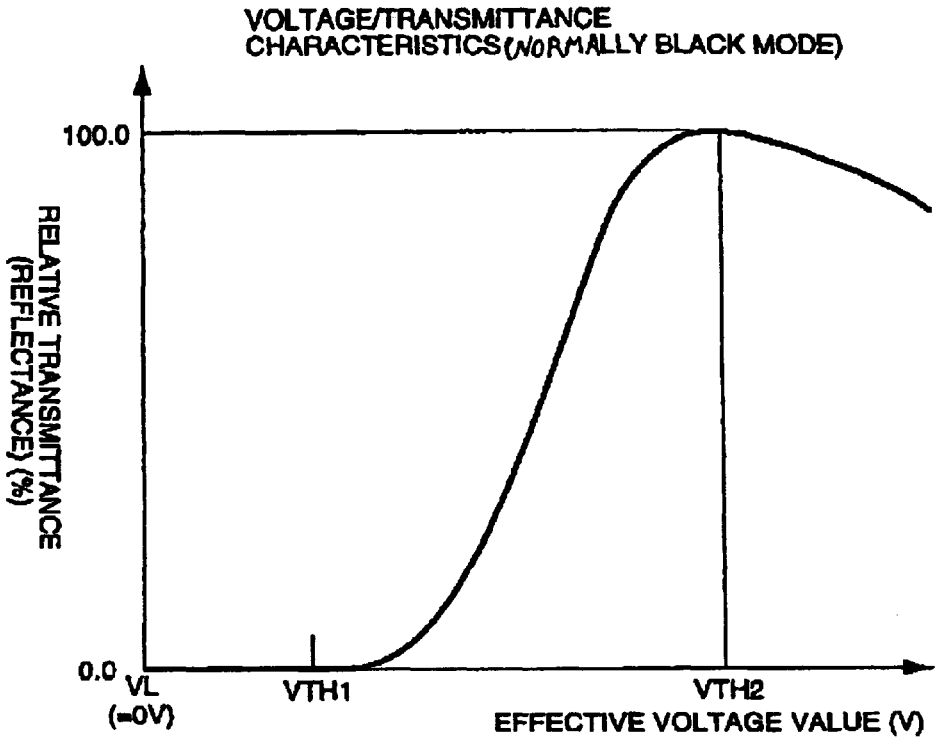
FIG. 8 is a chart showing the voltage/transmittance characteristics of a liquid crystal according to a modified embodiment of the present invention.

(2) Although the voltage/transmittance characteristics of the liquid crystal used in this embodiment are shown in FIG. 4, not all liquid crystals exhibit the characteristics shown in FIG. 4. Some liquid crystals have the voltage transmittance characteristics shown in, for example, FIG. 8. Namely, in such liquid crystals, when a voltage of threshold voltage VTH2 or more is applied, transmittance decreases with the applied voltage. In this case, the reset period TR is preferably changed according to the characteristics of the liquid crystal used to set the duty ratio of the pulse signal PW so that a voltage effective value equal to threshold voltage VTH2 is given to the maximum values "H", "H" and "H" of the gradation data shown in FIG. 6(*b*).

(3) Although, in this embodiment, the element substrate 101 constituting the electrooptic device includes a glass or quartz amorphous substrate, and TFTs are formed on the amorphous substrate by depositing a semiconductor thin film to form a transmissive device, the present invention is not limited to this type. For example, a reflecting layer may be provided on the element substrate 101 or the counter substrate 102 to form a reflective type, or the element substrate 101 made of single crystal silicon, on which the pixel electrodes 135 made of a reflecting metal, such as aluminum or the like, are formed, and the counter substrate 102 made of glass may be used to form the reflective electrooptic device 100.

In this case, the circuits of each of the pixels 13, i.e., the memory cell 130, the gradation control circuit 138, and the switching circuit 139, are preferably provided opposite to the observation side with respect to the pixel electrode 135. This can eliminate the need to provide the regions to form there circuits between the respective pixel electrodes, thereby obtaining the effect of permitting an enhancement of the opening ratio of each pixel. Also, a SOI (Silicon on Insulator) substrate may be used as the element substrate 101. The SOI substrate is a substrate including an insulating material, a single crystal silicon layer provided thereon, and various elements formed on the silicon layer, and enables the realization of an increase in the speed of various circuits, and a reduction in power consumption.

(4) Furthermore, in the above embodiment, the present invention is applied to the electrooptic device using liquid crystal. However, the present invention can be applied to other electrooptic devices, particularly any electrooptic devices performing a gradation display by using pixels for on-and-off binary display. Possible examples of such electrooptic devices include an electroluminescence device, a plasma display, and the like, for example. Particularly, in a organic electroluminescence device, AC driving with a liquid crystal is not required to make polarity reversal unnecessary.

[Advantages]

As described above, in the present invention, a comparator circuit is realized by using first switching elements 1-1 to 1-n which are respectively switched according to first to n-bit gradation data (where n is a natural number of 2 or more), and which are connected in series between first and second terminals, and second switching elements 2-1 to 2-n which are respectively switched according to first to n-bit gradation signals successively updated, and which are connected in parallel to the first switching element 1-1 to 1-n, thereby decreasing the number of the switching elements constituting the comparator circuit. Therefore, it is possible to achieve lower power consumption, higher definition, and multi-gradation in an electrooptic device, or the like.

What is claimed is:

1. An electrooptic device, comprising:

a plurality of pixels to perform a gradation display according to a level of a supplied driving signal;

a pixel electrode provided for each of the pixels;

a memory to store n-bit (n being a natural number of 2 or more) gradation data of each of the pixels;

a pulse width modulation circuit including a comparator circuit to compare the gradation data stored in the memory and n-bit gradation signals, and a latch circuit to output a driving signal; and a switching circuit to apply at least one of a voltage to turn on each of the pixels and a voltage to turn off each of the pixels to the pixel electrode according to the driving signal level, the comparator circuit including:

n first switching elements respectively switched according to the n-bit gradation data and connected in series between first and second terminals;

n second switching elements respectively switched according to the n-bit gradation signals successively updated and respectively connected in parallel to the n first switching elements; and a conductive/nonconductive state between the first and second terminals being controlled according to the gradation data and the gradation signals, and results of comparison between the gradation data and the gradation signals being output to the latch circuit.

2. The electrooptic device according to claim 1, the pulse-width modulation circuit including:

the comparator circuit; and the latch circuit which is set to a first state when a first signal is input, and to a second state when a second signal is input, and to which the first signal is input when the comparator circuit is in the conductive state;

the second signal being input to the latch circuit within a predetermined reset period, the count results obtained by counting up or counting down several times without the reset period being supplied as the gradation signals to the comparator circuit; and the conductive/nonconductive state between the first and second terminals of the comparator circuit being controlled according to the result of comparison between the gradation data and the gradation signals to set the ratio of the time required for the latch circuit to maintain the first state to the time required for the latch circuit to maintain the second state without the reset period.

3. The electrooptic device according to claim 1, the pulse-width modulation circuit further including:

a third switching element to supply the second signal to the latch circuit in a conductive state; and a fourth switching element to supply the first signal to the comparator circuit in a conductive state;

the third switching element being set to the conductive state when the predetermined reset signal being in a reset command state, and the fourth switching element is set to the conductive state when the reset signal is in a non-reset command state.

4. The electrooptic device according to claim 1, further including a signal generating circuit to set the reset signal to the reset command state at the beginning of the reset period, and then setting the reset signal to the non-reset command state and outputting the count results obtained by counting up or counting down several times as the gradation signals.

5. The electrooptic device according to claim 1, each of the pixels including the pixel electrode, the memory, the pulse-width modulation circuit, and the switching circuit, the pixels being formed on an element substrate that includes a transparent substrate and a semiconductor thin film deposited thereon.

6. The electrooptic device according to claim 1, each of the pixels including the pixel electrode, the memory, the pulse-width modulation circuit, and the switching circuit, the pixels being formed on a single crystal silicon substrate.

7. The electrooptic device according to claim 6, the single crystal silicon substrate being a SOI substrate that includes an insulating substrate and a single crystal silicon layer formed thereon.

8. The electrooptic device according claim 1, the memory, the pulse-width modulation circuit, and the switching circuit being provided opposite to the observation side with respect to the pixel electrode.

9. The electrooptic device according to claim 1, further including:

an element substrate on which the pixels are formed;

a counter substrate provided with a counter electrode to which a predetermined reference voltage is applied; and a liquid crystal sandwiched between the element substrate and the counter substrate.

10. An electric apparatus, comprising:

the electrooptic device according to claim 1.

11. The electrooptic device according to claim 1, the n second switching element being connected in series between the first and second terminals.

* * * * *